United States Patent [19]

Kuntziger

[11] 4,022,573

[45] May 10, 1977

[54] HOT BLAST STOVE AND METHOD OF OPERATION

[75] Inventor: Ernest P. Kuntziger, Assenede, Belgium

[73] Assignee: S.A. des Anciens Etablissements Paul Wurth, Luxembourg, Luxembourg

[22] Filed: Sept. 10, 1975

[21] Appl. No.: 612,219

[30] Foreign Application Priority Data

Sept. 20, 1974 Luxembourg ..... 70951
Jan. 30, 1975 Luxembourg ..... 71761

[52] U.S. Cl. ..... 432/217; 432/216; 432/30; 432/40; 266/139

[51] Int. Cl.[2] ..... F24H 7/00

[58] Field of Search ..... 432/28–30, 432/40, 214, 216, 217, 219, 180, 181, 182, 54; 266/138, 139

[56] References Cited

UNITED STATES PATENTS

| | | | |
|---|---|---|---|
| 1,168,014 | 1/1916 | Landgrebe | 432/214 |
| 1,464,115 | 8/1923 | Steudel | 432/217 |
| 1,771,306 | 7/1930 | Nelson | 432/217 |
| 1,895,235 | 1/1933 | Simon | 432/217 |
| 3,241,823 | 3/1966 | Pentek | 432/216 |
| 3,297,310 | 1/1967 | Pentek | 432/214 |
| 3,902,844 | 9/1975 | Higashi | 432/214 |

*Primary Examiner*—John J. Camby
*Assistant Examiner*—Henry C. Yuen

[57] ABSTRACT

Intercrystalline stress corrosion of the walls of heat exchangers employed to produce hot air for injection into a blast furnace, particularly the wall of the passage interconnecting the combustion and heat exchange chambers, is avoided by eliminating pressure differentials across the walls. Also, the walls of the heat exchanger are heated to a temperature above the condensation point of deleterious vapors present or formed in the apparatus to thereby further minimize the possibility of occurrence of stress corrosion.

13 Claims, 2 Drawing Figures

HOT BLAST STOVE AND METHOD OF OPERATION

BACKGROUND OF THE INVENTION

1. Field of the Invention

The present invention relates to the heating of fluids and particularly to the heating of air for injection into a shaft furnace. More specifically, this invention is directed to heat exchangers and especially devices known in the art as hot blast stoves which are employed to heat gases to high temperatures. Accordingly, the general objects of the present invention are to provide novel and improved methods and apparatus of such character.

2. Description of the Prior Art

While not limited thereto in its utility, the present invention is particularly well suited for use with equipment which is ancillary to a blast furnace. Present blast furnace installations are provided, exterior of and adjacent the lower portion of the furnace proper, with an annular conduit which is known as the "hot blast conduit." The "hot blast conduit" is connected to the interior of the blast furnace via a number of transmission conduits known in the art as "tuyere stocks." Preheated air, known as "hot blast," is introduced into the blast furnace via the "hot blast conduit " and "tuyere stocks." The heating of the air to be injected into the furnace is performed in an ancillary device known as a "hot blast stove." Means, typically in the form of a mixing chamber, are interposed between the hot blast stove and the hot blast conduit to mix the heated air with cold air in the interest of regulating the temperature of the air which is introduced into the furnace to this maintain the injected air temperature constant. In a modern blast furnace the controlled temperature of the injected hot air may reach 1350° C.

A hot blast stove is functionally divided into two sections. The first section, which is a combustion chamber, is provided in its lower part with a burner. A combustible gas; typically a blast furnace gas enriched with coke gas, natural gas, or the like; is delivered to the burner. The combustion products; i.e., the thermal energy and heated gas resulting from burning the combustible gas in the presence of air; are directed through a second section of the hot blast stove, known as the checkerwork chamber, which is comprised of refractory bricks. Heat from the gases passing through the checkerwork chamber is transferred to and stored in the checkerwork of refractory bricks.

The operation of heating air in a hot blast stove is essentially a two step process. In the first step or period, known as the "stove on gas" phase, the combustible gas is burnt in the combustion chamber and the resulting combustion products ascend in the combustion chamber and then descend through the refractory checkerwork before delivered to an exhaust stack. The heat emitted by the combustion products is, as noted above, stored in the refractory material of the checkerwork.

During the second step or portion of the air heatng cycle, termed the "stove on blast" phase, "cold" air is introduced at the base of the refractory checkerwork at a pressure which may be in the range of 5–7 atmospheres. During the "stove on blast" phase the gas circulation in the hot blast stove is in the opposite direction of that which occurs during the "stove on gas" phase; i.e., the air passes through the refractory checkerwork first and then passes to the hot blast conduit via the combustion chamber. While passing through the checkerwork the air recovers heat which was stored in the checkerwork during the "stove on gas" phase.

As will be obvious from the above discussion, since a hot blast stove has two separate modes or phases of operation, a blast furnace installation requires the presence of at least two hot blast stoves to satisfy a continuous demand for preheated air; i.e., for a "hot blast." In a two stove installation one hot blast stove will be in the "stove on gas" phase while the other will be in the "on blast" phase.

In conventional hot blast stoves the combustion chamber and the refractory checkerwork are incorporated in a single brickwork structure which is a few dozen meters in height. In such hot blast stoves, known in the art at "hot blast stoves with incorporated combustion chamber," the combustion chamber is adjacent to the checkerwork and separated therefrom by a wall of refractory material. Prior art hot blast stoves with an incorporated combustion chamber suffer from the drawback of undergoing rapid deterioration. This deterioration is caused by gaseous short circuits which occur between the combustion chamber and the checkerwork. These short circuits lead to the destruction of the refractory material as a consequence of heat surges resulting from the considerable differences between the temperature prevailing on the opposite sides of the dividing wall. The increasingly high temperatures required for the hot air which is injected into modern blast furnaces have the effect of accelerating this deterioration.

Hot blast stoves wherein the combustion chamber is separated from the refractory checkerwork have been designed in an effort to enhance the operating life of the stoves. These devices, known as "hot blast stoves with separate combustion chamber," comprise two separate chambers; i.e., a combustion chamber and a checkerwork chamber; which are in communication via a cupola. For the reasons to be set forth below, the use of separate chambers has not solved the problem of hot blast stove deterioration in the face of the increasingly high temperature requirements for the hot blast air to be injected into a modern blast furnace. In hot blast stoves with separate combustion chambers the air may reach a temperature of 1500°–1550° C in the zone of the cupola. This enables a controlled temperature of 1350° C to be obtained for the air to be injected into the furnace.

Attempts have been made to prevent the deterioration of hot blast stoves by resort to new refractory materials; particularly materials with a silica base. Additionally, steel jackets have been installed in the cupolas of hot blast stoves which operate at very high temperatures and high pressures. For the reasons to be set forth below, the use of the most advanced refractory materials and the employment of steel jackets have not solved the deterioration problem.

An unexpected problem, which has been termed "intercrystalline stress corrosion," has recently manifested itself. This "intercrystalline stress corrosion" causes deterioration of the steel jackets of the cupolas of hot blast stoves operating at high temperatures and pressures. The intercrystalline stress corrosion phenomenon is due to the simultaneous existence of three conditions; i.e., high temperature, high pressure and the existence of ions of nitrous oxide, chlorine and sulfur.

The nitrous oxide ions form during the combustion of gases at a high flame temperature; i.e., above 1300° C; in the combustion chamber, during the heating of the "cold" air to temperatures in excess of 1400° C and during contact of the air with the bricks of the hot blast stove which are themselves heated to the range of 1500°–1550° C. The chlorine and sulfide ions are introduced by the insufficiently purified combustible gas delivered to the burner in the combustion chamber.

The steel plates or jackets of the cupola of a hot blast stove are subjected to comparatively large physical stresses as a result of both the residual stresses produced by the welding steps during fabrication and from the pressure exerted on the hot blast stove during the "stove on blast" operational mode. The repeated application and removal of pressure during the operation of a hot blast stove will ultimately lead to the creation of microcrystalline cracks in the steel jacket. These microcrystalline cracks present no problem in themselves. However, the condensation of nitrous oxide, chlorine and sulfide ions in these cracks results in occurrence of the intercrystalline stress corrosion phenomena.

To summarize, in order for the intercrystalline stress corrosion phenomena to occur within the cupola of a hot blast stove the above-mentioned three conditions must simultaneously occur; i.e., there must be a high temperature, a high pressure and the condensation of nitrous oxide, chlorine and sulfide ions. The microcrystalline cracks in the steel blast stove cupola jacket can not form without the existence of high pressure and pressure fluctuations. The ions of nitrous oxide, chlorine and sulfur must be formed, requiring a high temperature, and must condense in the cracks. As will be obvious to those skilled in the art, the problem of intercrystalline stress corrosion can not be overcome by reducing the pressure within the hot blast stove or by reduction in operating termperature; both of these potential solutions being at variance with modern blast furnace technology which requires high "hot blast" air pressures and temperatures for increased productivity and enchanced quality.

In order to alleviate the intercrystalline stress corrosion phenomena it has been suggested that the internal wall of the cupola of a hot blast stove be provided with a coating of aluminum in the form of either an aluminum base paint or actual sheets of aluminum. This proposed solution, however, has not proven successful since the high temperatures and pressures in the cupola zone of hot blast stoves results in failure of such coatings.

To briefly summarize, despite all efforts made to date, an effective means and apparatus for preventing intercrystalline stress corrosion to occur in and thus limit the operational life of a cupola of a hot blast stove has not previously been devised. As a result of this failure to provide an effective means of preventing intercrystalline stress corrosion, and because of the frequent maintenance which must accordingly be performed on the hot blast stoves, progress toward use of higher hot air temperatures and pressures in blast furnaces has been abortive.

SUMMARY OF THE INVENTION

The present invention overcomes the above discussed and other deficiencies and disadvantages of the prior art by providing an improved heat exchange device and particularly a novel and improved hot blast stove for use in the production of hot air for injection into a blast furnace. The present invention also contemplates a novel technique for substantially eliminating intercrystalline stress corrosion within a heat exchange device. Thus, the principal object of the present invention is to enhance the operating life of hot blast stoves.

Apparatus in accordance with the present invention comprises a hot blast stove wherein the upper portion comprises a cupola with a pair of spatially displaced walls which define a pressure equalization chamber. A fluid is caused to circulate in this chamber at a pressure equal to that prevailing within the hot blast stove. This technique of pressure equalization eliminates one of the principal causes of intercrystalline stress corrosion by preventing the formation of microcrystalline cracks as a result of pressure fluctuations across the cupola shell.

In accordance with a first embodiment of the invention the chamber through which the fluid is circulated forms part of a cold air feed circuit and also in part defines the combustion air feed circuit. The enclosure is connected to one or the other of the air feed circuits as necessary by means of a set of valves.

In accordance with a second embodiment of the invention the chamber through which the pressure equalizing fluid is circulated forms part of a closed circuit in which forced circulation of the said fluid is effected.

In addition to elimination of the influence of pressure on the shells or jacket which defines the internal surfaces of the cupola of a hot blast stove, thus preventing microcrystalline cracks from forming and thereby eliminating regions in which intercrystalline stress corrosion can begin, the present invention also contemplates control of the temperature of the fluid circulated within the enclosure in such a manner as to raise the temperature of the internal shell of the cupola above the condensation point of the vapors of nitrous oxide, chlorine and sulfur. Thus, the present invention, in the preferred embodiments, contemplates the exercise of control over two of the parameters required for intercrystalline stress corrosion; i.e., pressure and the availability of deleterious materials on the walls subject to corrsion.

BRIEF DESCRIPTION OF THE DRAWING

The present invention may be better understood and its numerous objects and advantages will become apparent to those skilled in the art by reference to the accompanying drawing wherein like reference numerals refer to like elements in the two figures and in which.

DESCRIPTION OF THE PREFERRED EMBODIMENTS

Figure 1:
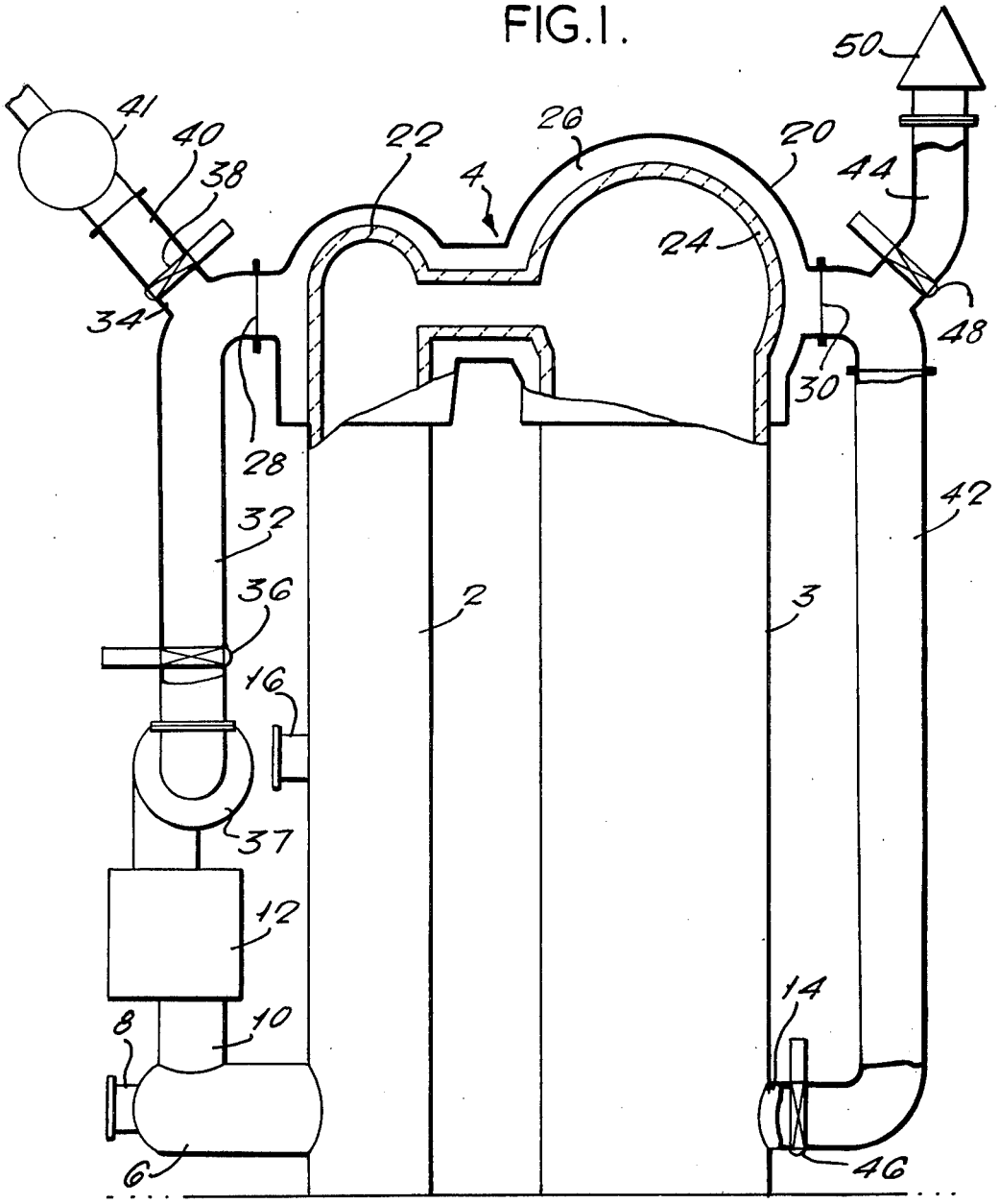
FIG. 1 is a schematic vertical section through a first embodiment of a hot blast stove embodying the present invention.

With reference now to FIG. 1, a hot blast stove of the separate combustion chamber type is shown schematically. The stove of FIG. 1 comprises a combustion chamber 2 and a checkerwork chamber 3. Combustion chamber 2 and checkerwork chamber 3 are in fluid communication via a cupola, indicated generally at 4, which defines the fluid connection between the two chambers.

A burner 6 projects into the lower part of the combustion chamber 2. Blast furnace gas, enriched with coke gas or natural gas, is injected into burner 6 through a nozzle 8. Preheated combustion air is also delivered to burner 6 via a feed pipe 10. The combustion air is heated, prior to being delivered to burner 6, in a heat exhanger 12. The mixture of enriched furnace gas and heated combustion air is burnt in combustion chamber 2 and the heat and gases resulting from this combustion travel upwardly in combustion chamber 2 and are delivered via cupola 4 to the checkerwork chamber or shaft 3. As noted above, checkerwork shaft 3 comprises a refractory brickwork; the bricks typically having a silica base. The heat resulting from the combustion in chamber 2 is transferred to the brickwork in shaft 3; the greatest degree of heating occurring in the upper part of the checkerwork and in the region of the cupola. After passing downwardly through the checkerwork shaft 3 the gases resulting from combustion in chamber 2 are evacuated through an orifice, not shown, in the lower part of shaft 3 and delivered to an exhaust stack, also not shown. During the combustion and heating of the refractory checkerwork, known as the "stove on gas" mode, the pressure prevailing within the hot blast stove is slightly above atmospheric pressure.

When the refractory walls of checkerwork shaft 3 reach the required temperature, combustion is stopped by shutting off the supply of fuel to burner 6 and the hot blast stove is switched over to the "stove on blast" mode of operation. In the "stove on blast" mode "cold" air is introduced under pressure into the checkerwork shaft 3 via an orifice 14 provided at the base of shaft 3. The air introduced through orifice 14 passes through the hot blast stove in the opposite direction to the travel of the combustion gases during the "stove on gas" phase. As the air injected through orifice 14 rises through checkerwork shaft 3 it is heated through contact with the refractory material. The resultant hot air passes from shaft 3 into combustion chamber 2, via cupola 4 and leaves the hot blast stove via a discharge orifice 16 provided in the side wall of combustion chamber 2. As will be obvious, a valve, not shown, is associated with hot air outlet orifice 16 so that this orifice will be open only during the "stove on blast" mode.

The pressure of the air in modern hot blast stoves during the "stove on blast" operation averages five to six atmospheres, with a maximum pressure of seven atmospheres. The temperature in the hottest region of present high temperature hot blast stoves; i.e., in the region of cupola 4; may reach 1550° C.

As discussed above, at the temperatures and pressures at which hot blast stoves associated with modern blast furnaces are required to operate, a phenomena known as intercrystalline stress corrosion may occur. This phenomena, which was not encountered in prior art hot blast stoves which operated at lower temperatures an pressures, cause rapid destruction of the protective steel jackets within the domes of the cupolas; cupola 4 of the hot blast stove of FIG. 1 having a pair of domes 22 and 24 respectively above the combustion chamber and checkerwork shaft. As also noted above, in order for intercrystalline stress corrosion to occur there must be a high temperature, a high pressure and deleterious vapors must be deposited on the walls of the stove.

In accordance with the present invention the effect of the high pressure in the hot blast stove during the "stove on blast" operational mode is eliminated by providing the cupola with double walls and introducing a pressurized fluid between these walls. The pressurized fluid acting on the outside of the inner cupola wall offsets the pressure to which the inside of the internal wall is subjected thus avoiding the necessity of reducing the pressure within the hot blast stove. Best results are obviously obtained when the pressure on the two sides of the internal wall of the cupola are approximately equal; i.e., when the fluid introduced between the double walls of the cupola is at a pressure approximately equal to that prevailing inside the hot blast stove.

Referrinfg again to FIG. 1, an outer jacket or hermetic wall 20 is, in accordance with the present invention, provided about the exterior of the cupola 4 of the hot blast stove. Wall 20 is spaced a slight distance from the external steel jacket of the dome portions 22 and 24 of cupola 4. The wall 20 thus defines, with the domes 22 and 24, an enclosure or pressure equalization chamber 26. A fluid is caused to circulate within chamber 26 at a pressure such that the pressure differential across the internal walls of the cupola, such as the walls which define domes 22 and 24, is approximately zero.

Fluid communication with enclosure 26 is via a pair of orifices 28 and 30 situated respectively at the combustion chamber and checkerwork chamber sides of the hot blast stove. Orifices 28 and 30 function as either inlet or outlet orifices depending upon the mode of operation of the hot blast stove.

The orifice 28 communicates with conduits 32 and 34 which respectively are provided with valves 36 and 38. The conduit 32 and valve 36 connect orifice 28, via a ventilator or fan 37 and the heat exchanger 12, to burner 6. The conduit 34 and valve 38 connect orifice 28 to a "cold" air feed pipe 40. In the discussion of the present invention the terms "cold air" and "hot air" are relative in relation to each other. In actual practice the temperature of the "cold" air as provided via feed pipe 40 will typically be as high as 150° C. This temperature is imparted to the air by the compressors 41 which serve to pressurize the "cold" air as required for operation of the hot blast stove during the "stove on blast" mode.

The orifice 30 is in communication with conduits 42 and 44 which respectively contain valves 46 and 48. Conduit 42 and valve 46 connect chamber 26 to the cold air admission orifice 14 in the lower part of the checkerwork shaft 3. The conduit 44 and valve 48 define a suction intake which couples chamber 26 to an adjustable valve 50; valve 50 controlling the admission of combustion air.

When the hot blast stove is in the "stove on gas" mode, the valves 36 and 46 are closed and the ventilator 37 is in operation. Combustion air is taken in by suction via valve 50 and passes through chamber 26 before being delivered to burner 6 to support combustion of the gases being injected via nozzle 8; transmission of the combustion air being via conduit 32, valve 36, ventilator 37, heat exchanger 12 and feed pipe 10. Under these conditions the pressure in chamber 26 around cupola 4 is equal to atmospheric pressure. The pressure inside of the hot blast stove in the "stove on gas" mode is also approximately equal to atmospheric pressure. Accordingly, during the "stove on gas" mode there will be no pressure differential across the inner wall of cupola 4.

During the "stove on blast" mode the valves 36 and 48 are closed and the valves 38 and 46 are open. This valve setting establishes, via the chamber 26 around cupola 4, a connection between the "cold" air feed pipe 40 and the air admission orifice 14 at the base of checkerwork shaft 3. In the "stove on blast" mode the "cold" air delivered via feed pipe 40 will be at a pressure which may reach seven atmospheres; this pressure being produced by compressors as described above. Accordingly, the pressure inside of the hot blast stove is substantially the same as the pressure in chamber 26 during the "stove on blast" mode since the pressurized "cold" air passes through chamber 26 prior to being delivered to checkerwork shaft 3 for additional heating. The walls of the cupola, accordingly, are not subjected to physical stresses resulting from a pressure differential there-across An important feature of the present invention is the use of the chamber or enclosure 26 surrounding the cupola 4 as an integral part of the feed conduit either for the combustion air. The enclosure 26 thus, in addition to its pressure equalizing function, enables both the "cold" air and the combustion air to be preheated.

To briefly summarize the above discussion, the effects of pressure on the plates or lining of the cupola of a hot blast stove are eliminated by providing a pressure equalization chamber about the internal wall of the cupola and delivering a suitably pressurized fluid to that chamber. The elimination of the influence of pressure, and particularly the elimination of pressure differentials across the inner lining of the cupola of a hot blast stove, prevents the formation of microcrystalline cracks thereby minimizing the possibility of intercrystalline stress corrosion occurring.

Also in accordance with the present invention, the possibility of development of intercrystalline stress corrosion is further diminished by providing for the control of the temperature of the fluid circulating in the enclosure or pressure equalization chamber about the cupola of a hot blast stove. This temperature control is effected so as to raise the temperature of the internal wall of the cupola above the condensation point of the vapors which contribute to intercrystalline stress corrosion. Thus, referring again to FIG. 1, in order to prevent vapor consensation during the "stove on blast" phase, the temperature of the "cold" air circulating through chamber 26 must be sufficiently high to keep the temperature of the internal walls of the cupola above the vapor condensation point. Tests have shown that if the internal wall of the cupola is kept at a temperature of 150° C vapor condensation will be prevented or substantially reduced. Consequently, since the temperature of the "cold" air delivered via compressors to fed pipe 40 is typically in the range of 150° C, the temperature of the "cold" air is in itself sufficient to heat the walls of the cupola to the point where vapor condensation is prevented or substantially reduced.

It is to be observed that it is also possible to provide a heat exchanger situated in the "cold" air supply pipe to keep the temperature of the "cold" air at a desired level. The heat exchanger could also be controlled to insure that the temperature of the "cold" air would be varied in accordance with the requirements and particula characteristics of the hot blast stove.

Figure 2:
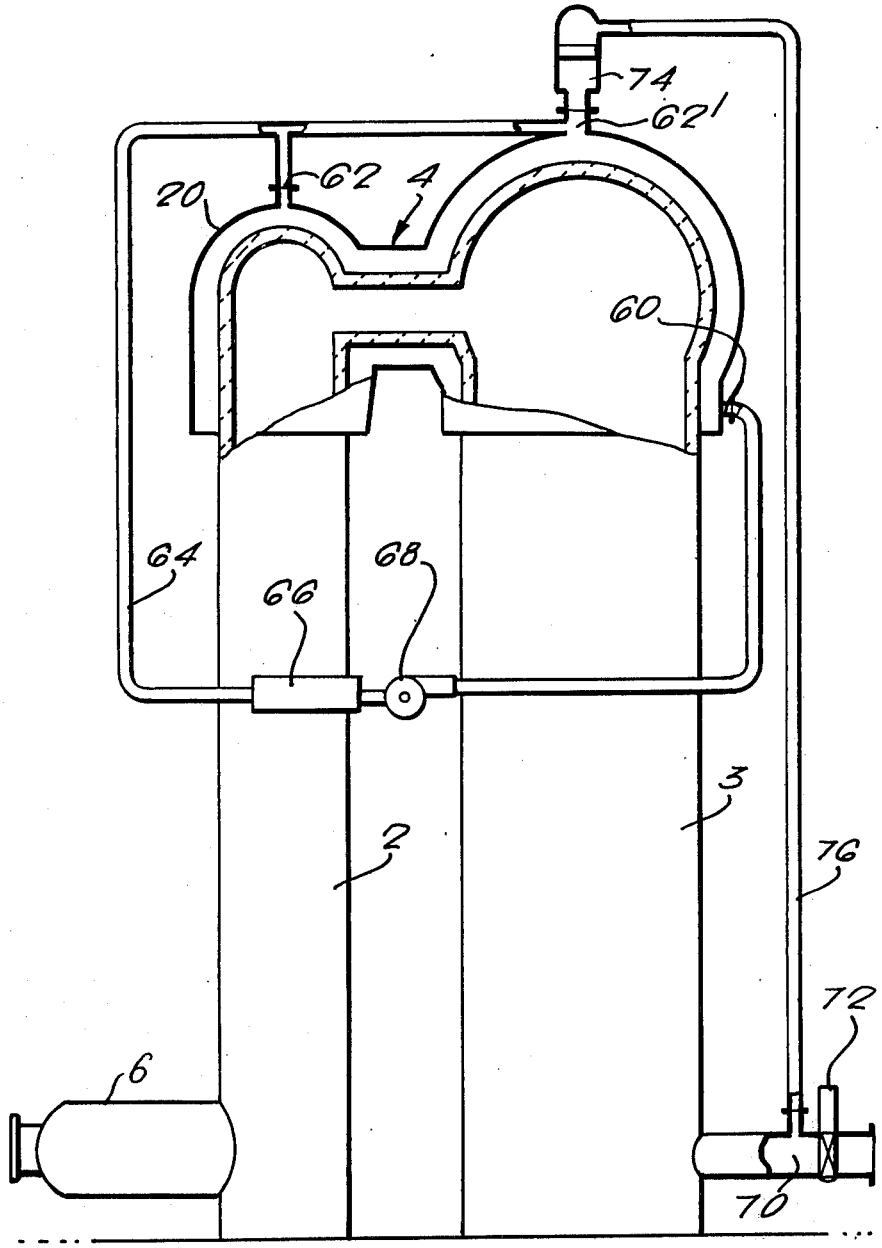
FIG. 2 is a schematic vertical section through a hot blast stove in accordance with a second embodiment of the invention.

Considering now the FIG. 2 embodiment, the hot blast stove depicted is also of the separate combustion type and comprises a combustion chamber 2 connected to a checkerwork chamber 3 by means of a cupola 4. As in the embodiment of FIG. 1, the inner wall of cupola 4 is envoloped by an outer wall 20 with the space between the walls defining a pressure equalization enclosure 26 which extends all around the cupola 4.

The embodiment of FIG. 2 may be distinguished from that of FIG. 1 by the incorporation of a closed circuit for the circulation of fluid through the pressure equalization enclosure 26. In FIG. 2 embodiment the fluid, which may advantageously consist of oil, remains in enclosure 26 at all times.

Continuing with a description of the FIG. 2 embodiment, the hot blast stove is provided with an admission orifice 60 for the fluid being circulated through the pressure equalization enclosure and a pair of outlet orifices 62 and 62′. The outlet orifices are situated at the highest points of the chamber; i.e., above the domes of the cupola; in order to prevent the hot oil or other fluid from accumulating at such points. The outlet orifices 62 and 62′ are connected to orifice 60 via a conduit 64 which has, disposed therein, a heat exchanger 66 and a circulator pump 68. During the "stove on blast" operational mode pressurized "cold" air is fed into the lower part of the checkerwork shaft 3 via a conduit 70 which includes an admission valve 72. A pressure compensation device 74, which is in communication with enclosure 26, is coupled to conduit 70 at the checkerwork shaft side of valve 72 by a conduit 76. The conduit 76 thus serves as a pressure sensing line for the pressure compensator 74 which serves to adjust the pressure of the oil or other fluid being circulated through the pressure equalization enclosure 26 to a pressure approximately equal to that prevailing in the hot blast stove. The pressure compensator 74 operates principally when the hot blast stove is being switched over from the "stove on gas" to the "stove on blast" mode and vice versa; i.e., pressure compensator 74 normally operates when any appreciable change takes place in the pressure inside the hot blast stove.

To summarize, in the embodiment of FIG. 2 the pressure in the enclosure about the cupola of the hot blast stove is constantly adjusted to a level approximately equal to the pressure inside the stove. This operation eliminates the establishment of pressure differentials across the inner wall of the cupola of the hot blast stove and thus prevents the formation of microcrystalline cracks in the wall of the cupola.

In the FIG. 2 embodiment the heat exchanger 66 may be employed to maintain the temperature of the fluid circulating within the pressure equalization chamber at a level such that the inner wall of the cupola will be maintained above the vapor condensation temperature. This effect may be achieved by providing an adjustable thermostat which controls the operation of heat exchanger 66 in accordance with the temperature of the fluid circulating in the closed circuit.

As will now be obvious to those skilled in the art, the present invention eliminates the establishment of pressure differentials across the inner wall of the cupola of a hot blast stove and also controls the temperature of the walls of the cupola of a hot blast stove so as to minimize vapor condensation thereon. Thus, the present invention eliminates or minimizes two of the parameters necessary for the establishment of intercrystalline stress corrosion thereby substantially enhancing the operational life of hot blast stoves which operate at high temperatures and high pressures.

While preferred embodiments have been shown and described, various modifications and substitutions may be made thereto without departing from the spirit and scope of the present invention. Thus, while the present invention has been discussed in the environment of a hot blast stove with a separate combustion chamber, the invention may be applied to hot blast stoves with incorporated combustion chambers. Accordingly, it is to be understood that the present invention has been described by way of illustration and not limitation.

What is claimed is:

1. In apparatus for heating a fluid, said heating apparatus including a combustion chamber in which heat is generated and a heat transfer chamber in which the generated heat is stored for subsequent transfer to a fluid passing therethrough, deleterious vapors being admitted to the heating apparatus during combustion of hydrocarbon fuel in the combustion chamber, the combustion and heat exchange chambers being in fluid communication at first ends via a passage at least in part defined by an imperforate wall having a first inwardly facing surface exposed to the conditions produced in said heating apparatus during combustion and recovery of the stored heat, the improvement comprising:

means positioned to the exterior of the heating apparatus and cooperating with said imperforate passage defining wall to form an enclosure, the second outwardly facing surface of said wall being exposed to the conditions existing within the enclosure and being isolated from the conditions existing within the heating apparatus; and means for delivering a fluid to said enclosure at a pressure approximately equal to that prevailing within said heating apparatus to thereby eliminate pressure differentials across said wall and the mechanical stresses resulting from pressure differentials.

2. The apparatus of claim 1 further comprising:

means for causing the fluid delivered to said enclosure to be at a sufficiently high temperature to maintain the passage defining wall at a temperature above the condensation point of deleterious vapors present in the apparatus.

3. The apparatus of claim 1 wherein said combustion chamber and heat transfer chamber comprises a hot blast stove for producing hot air to be injected into a blast furnace, said hot blast stove including means for supplying combustion air to the combustion chamber for supporting combustion and pressurized air to the heat exchange chamber for heating, said improved hot blast stove further comprising:

means coupling said combustion air supplying means to said enclosure;

means coupling said pressurized air supplying means to said enclosure; and valve means associated with said coupling means for alternately delivering combustion air to the combustion chamber via said enclosure and pressurized air to said heat exchange chamber via said enclosure.

4. The hot blast stove of claim 3 further comprising:

means for causing the pressurized air delivered to said enclosure to be at a sufficiently high temperature to maintain said passage defining wall at a temperature above the condensation point of deleterious vapors present in the stove.

5. The apparatus of claim 1 wherein said combustion chamber and heat transfer chamber comprises a hot blast stove for producing hot air to be injected into a blast furnace said hot blast stove including means for alternately supplying combustion air to the combustion chamber for supporting combustion and pressurized air to the heat exchange chamber for heating, and wherein said means for delivering a pressurized fluid to said enclosure comprises:

a closed fluid circuit connected in series with the enclosure; and pump means in said fluid circuit for causing the forced circulation of fluid therein.

6. The hot blast stove of claim 5 wherein the fluid in said closed circuit comprises oil.

7. The hot blast stove of claim 5 further comprising:

means in said fluid circuit for causing the fluid delivered to said enclosure to be at a sufficiently high temperature to maintain said passage defining wall at a temperature above the condensation point of deleterious vapors present in the stove.

8. The hot blast of claim 7 wherein said means for causing the fluid in said closed circuit to be at a sufficiently high temperature comprises:

a heat exchanger.

9. The hot blast stove of claim 5 further comprising:

pressure compensator means connected to said closed fluid circuit; and pressure sensor means coupling said pressure compensator means to a point where the stove interior pressure exists whereby said pressure compensator means will adjust the pressure in said enclosure to be approximately equal to that prevailing inside the stove.

10. The hot blast stove of claim 9 further comprising:

means in said fluid circuit for causing the fluid delivered to said enclosure to be at a sufficiently high temperature to maintain said passage defining wall at a temperature above the condensation point of deleterious vapors present in the stove.

11. The hot blast stove of claim 10 wherein said means for causing the fluid in said closed circuit to be at a sufficiently high temperature comprises:

a heat exchanger.

12. The hot blast stove of claim 11 wherein the fluid in said closed circuit comprises oil.

13. The hot blast stove of claim 9 wherein the fluid in said closed circuit comprises oil.

* * * * *